United States Patent [19]

Roberts

[11] Patent Number: 4,483,660

[45] Date of Patent: Nov. 20, 1984

[54] SUBMERSIBLE PUMP IMPELLER LOCKING METHOD

[75] Inventor: Leo L. Roberts, Claremore, Okla.

[73] Assignee: Hughes Tool Company, Houston, Tex.

[21] Appl. No.: 378,303

[22] Filed: May 14, 1982

[51] Int. Cl.[3] ..... B32B 31/04

[52] U.S. Cl. ..... 416/213 A; 416/213 R; 415/501; 415/199.1; 29/156.8 R; 264/230; 156/83

[58] Field of Search ..... 415/199.1, 501; 29/156.8 R, 156.8 P, 447; 416/213 R, 213 A; 156/83, 294, 307.3, 331.2, 307.1; 264/248, 262, 267, 340, 343, 345, 234, 232, 237, 230

[56] References Cited

U.S. PATENT DOCUMENTS

| | | | |
|---|---|---|---|
| 1,569,092 | 1/1926 | Keating | 415/199.1 |
| 2,433,589 | 12/1947 | Adams | 415/169 |
| 3,801,226 | 4/1974 | Bevan et al. | 416/241 B |
| 3,897,713 | 8/1975 | Gugle | 411/389 |
| 3,945,874 | 3/1976 | Backstrom et al. | 156/294 |
| 4,170,620 | 10/1979 | Rao et al. | 264/230 |
| 4,171,560 | 10/1979 | Garrett | 264/262 |
| 4,244,675 | 1/1981 | Bower | 415/199.1 |

FOREIGN PATENT DOCUMENTS

| | | | |
|---|---|---|---|
| 527337 | 9/1977 | U.S.S.R. | 416/213 A |

*Primary Examiner*—Samuel Scott
*Assistant Examiner*—B. J. Bowman
*Attorney, Agent, or Firm*—Robert A. Felsman; James E. Bradley

[57] ABSTRACT

A method of installing the diffusers and impellers on a shaft of a centrifugal pump uses a latent locking member. The locking member is positioned within a counterbore of each impeller when the impellers are placed on the shaft between each diffuser. After positioning, the locking member is activated to bond the impellers to the shaft. Preferably, the locking member is a heat activated material that requires heat for the material to become fluid. On cooling, the adhesive forms a rigid bond with the shaft.

2 Claims, 1 Drawing Figure

SUBMERSIBLE PUMP IMPELLER LOCKING METHOD

BACKGROUND OF THE INVENTION

This invention relates in general to submersible pumps, and in particular to a method and apparatus for locking the impellers of a centrifugal pump within the diffusers.

One type of submersible pump is a centrifugal type that has a tubular housing. A shaft driven by a submersible motor extends through the housing. Stages of diffusers are mounted in the housing stationarily. An impeller is carried inside each diffuser for rotation with the shaft. The rotating motion of the impeller imparts a rotating motion to the liquid, causing it to pass through the diffuser stages with successively increased pressure.

During assembly of the pump, diffusers and impellers are alternately placed over the shaft, then this assembly is placed inside the housing. Prior to placing the assembly in the housing, the impellers must be located relative to the diffusers. In one method, a locking ring or spring provides a specified locking force to hold the impellers to the shaft. Using this method, all parts must be precisely machined. In another method, shims are placed between the impellers. This method is slow and tedious because of the different dimensions.

SUMMARY OF THE INVENTION

In the method of this invention, a locking material is attached to the impellers before assembly. This locking material is latent, and preferably is the type that activates when heated to a certain temperature. The pump is assembled using normal procedures, differing only by the use of the locking material. Once assembled, the impellers are positioned at their proper places between the diffusers. Then the locking material is activated by heating the entire assembly. This causes the locking material to expand, mechanically and frictionally locking the impellers to the pump shaft. Each impeller will be precisely located and fixed both axially and rotationally to the shaft.

DESCRIPTION OF THE PREFERRED EMBODIMENT

Figure 1:
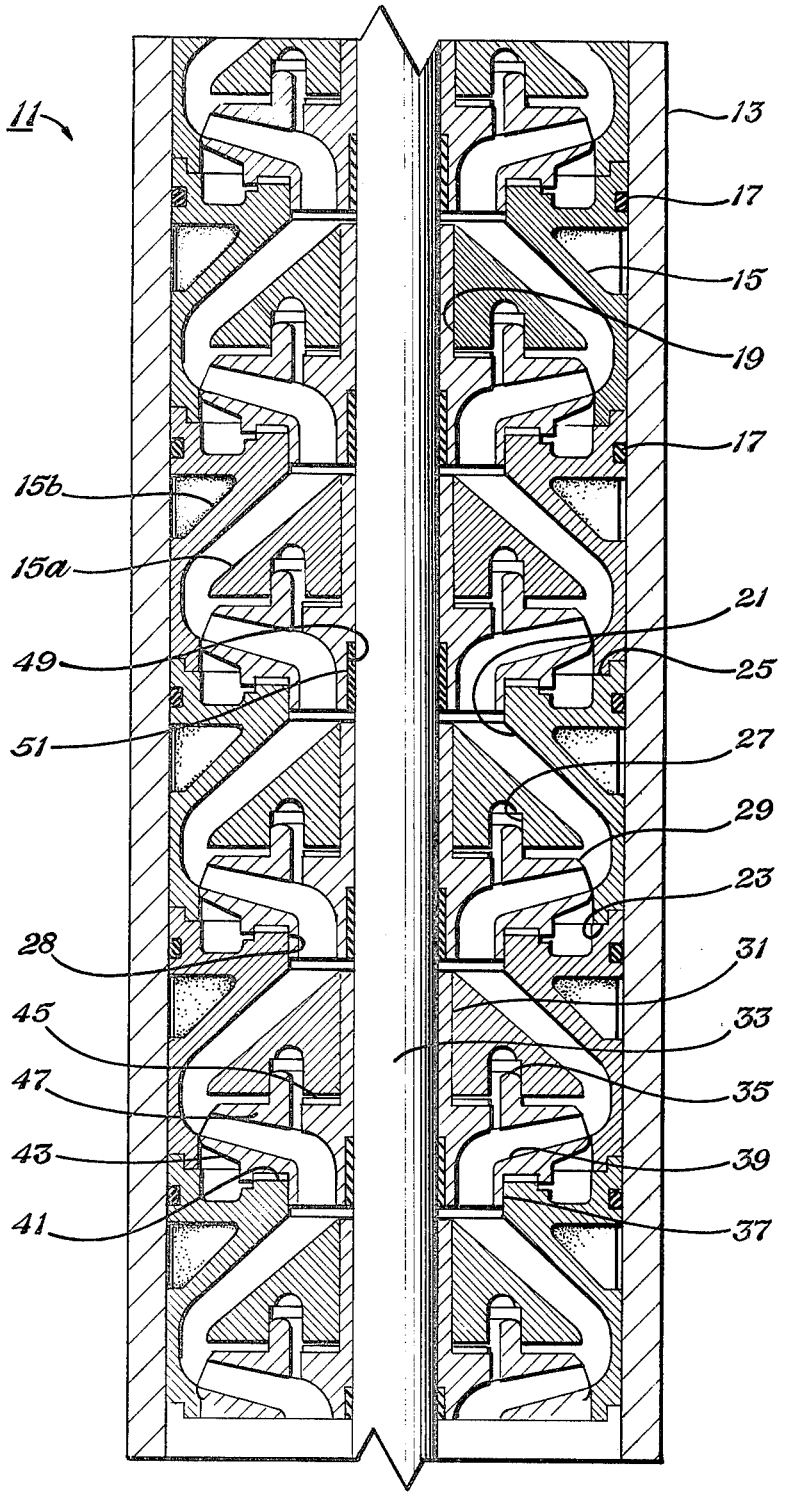
FIG. 1 is the sole FIGURE and illustrates a vertical sectional view of part of a pump constructed in accordance with this invention.

Referring to FIG. 1, pump 11 includes a cylindrical housing 13. A plurality of diffusers 15 are stacked one on another inside housing 13. Diffusers 15 are of conventional design. Each diffuser has an outer portion 15*b* that engages the inner wall of housing 13 and is sealed by an O-ring 17. Each diffuser 15 has an inner portion 15*a* containing a bore 19. A plurality of passages 21 extend through each diffuser. The inner portion 15*a* is located inward of passages 21 and the outer portion 15*b* outward of passages 21. Each diffuser outer portion 15*b* has a lower end 23 and an upper end 25 that contact adjacent diffusers 15. On the lower side of the inner portion 15*a* of each diffuser, an annular groove 27 is formed. An annular cavity 28 is located on the upper side of each diffuser 15.

An impeller 29 is carried within each diffuser. Impeller 29 may be of various conventional shapes and includes a hub 31 that extends the length of impeller 29 and is in engagement with a shaft 33 which extends longitudinally through housing 13. Hub 31 is tubular, with its outer wall being closely received within the bore 19 of the diffuser inner portion 15*a*. Each impeller 29 has an annular balance ring 35 that extends upwardly and is slidingly carried inside annular groove 27. A skirt 37 is formed on the lower portion of impeller 29 and is rotatably received within the cavity 28 of the diffuser immediately below. A plurality of passages 39 extend from the lower end of skirt 37 upwardly and outwardly to register with the diffuser passages 21. Washers or rings 41 are placed on a lower shroud 43 of each impeller 29. Washer or rings 45 are located on an upper shroud 47 of each impeller 29.

The lower end of the hub 31 has a recess or counterbore 49 that is greater in diameter than shaft 33 and extends upwardly a selected distance. Counterbore 49 contains a locking, bonding, or adhesive member 51 that is latent when assembled. The locking member 51 is preferably a thermosetting polymer or rubber material that is a solid flexible strip when initially at room temperature. When heated, the locking member 51 will expand or activate, fictionally bonding in an axial direction, the impeller 29 to the shaft 33. On subsequent cooling, the locking material will remain in its expanded form, retaining the bond. Further heating after cooling will not again cause expansion.

One type of locking material 51 that is suitable is an elastomeric material having the following constituents:

| Material | Parts |
|---|---|
| 1. Paracril BJLT | 300 |
| 2. N-660 GTE | 60 |
| 3. Octamine | 3 |
| 4. Stearic Acid | 4.5 |
| 5. Zinc Oxide | 15 |
| 6. Dixie Clay | 30 |
| 7. DBSS | 27 |
| 8. Durez 12687 | 45 |
| 9. MBTS | 1.5 |
| 10. Sulphur | 4.5 |
| 11. Celogen | 9.0 |
| | 500.4 Grams |

1. "Paracril BJLT" is a butadiene-acylonitrile copolymer nitrile elastomer made by Uniroyal Chemical Co., specific gravity 0.99, Mooney viscosity; ml-4, 121° F., 45-60, low temperature polymerized, 32.5% ACN, light amber color, contains nonstaining, nondiscoloring stabilizer system.
2. Commercially available.
3. "Octamine" is the reaction product of dipheylamine and diisobutylene made by Uniroyal Chemical Co., has a specific gravity of 0.99, is light brown, granular, waxy solid with a melting point of 75-85° C.
4. Commercially available.
5. Available from Gulf & Western National Resources Group; has a specific gravity of about 5.6; is an odorless, white powder.
6. Available from R.E. Carroll; has a specific gravity of 2.60; is an odorless, nontoxic light cream, colored powder; 99.75% passes a 325 mesh screen; 1% maximum moisture content.
7. Dibutyl Sebacate is available from Harwick Chemical Co.; it has a specific gravity of 0.93-0.94; it is a nontoxic, colorless, liquid, has a slight residual odor; distillation range 344-349° C.; melting point about 11° C.; flash point about 180° C.; density 7.8 lb./gallon.
8. Durez 12687 resin is a powdered thermosetting two-step phenolic resin. It is generally used in the preparation of nitrile compounds and cements.
9. MBTS is 2,2' Di-Benzothiazyldisulfide available from Uniroyal Chemical Co., it has a specific gravity of 1.54, is a nontoxic, pale yellow, free flowing powder, 99% passes 100 mesh screen, melting point of about 170° C.
10. Natural sulfur is available from Akron Chemical Co.; it has a specific gravity of about 2.07; is an odorless, nontoxic, yellow powder; melting point about 238° F.
11. Celogen OT is $p^1p^1$ oxybis - (benzenesulfonyl hydrazide) available, from Uniroyal Chemical Co.; it has a specific gravity of 1.52; is a fine, odorless white crystaline powder; decomposes at 150-160° C.

This elastomeric material 51 expands and hardens under heat. This material is also resistant to adverse conditions in the well, which includes water, heat, well chemicals, and abrasion.

To assemble the pump, a strip of locking material 51 about 1/32 inches thick is inserted in the counterbore 49 of the first impeller 29. The first impeller is placed over shaft 33 with the strip of locking material 51 wrapped around shaft 33. The first diffuser 15 is placed over shaft 33 with the bore 19 fitting over the upper end of the hub 31. The next impeller 29 with locking material 51 is placed over shaft 33 in contact with the upper end of the first diffuser 15. The next diffuser 15 is placed over the second impeller 29. This process is repeated until the full length of the impeller and diffuser section is completed. Each impeller is free to move axially a short distance between the diffusers 15 above and below it.

The impellers 29 and diffusers 15, after assembling on shaft 33, are placed in housing 13. The diffusers 15 are pressed together and locked in place in housing 13. The impellers 29 are then positioned between diffusers 29 at the proper clearances. In one method, the shaft 33 is pushed in one direction to cause all of the impellers 29 to be in contact with a diffuser 15 on the same side at the same time. Impellers 29 are free to move axially and rotationally on shaft 33 at this point, but the tight frictional engagement of the impellers 29 on shaft 33 allows them to move forward to contact an adjacent diffuser 15. The shaft 33 is then moved in the opposite direction to cause each impeller 29 to move and be in contact with the diffuser 15 on the opposite side at the same time. Then the shaft 33 is moved back the other direction a selected distance, causing each impellers 29 to be spaced evenly between two diffusers 15.

The assembly in housing 13 is then moved in a horizontal position to a furnace where it is heated to about 250° F. for one hour, a temperature sufficient to activate the locking member 51. The locking member 51 will expand to lock the impellers 29 frictionally to shaft 33. Some adhesive bonding takes place also. After cooling, the locking member 51 will harden, locking the impellers 29 to the shaft 33 both axially and rotationally.

In operation, an electric motor connected with the pump 11 will rotate shaft 33. This causes each impeller 29 to rotate, pumping fluid through the passages 21 and 39. Thrust may cause the impellers 29 to move slightly upward or downward with respect to diffusers 15. Should it be desirable to later remove the impellers from the shaft, a solvent can be used to loosen and dissolve the locking material.

The invention has significant advantages. Locking the impellers to the shaft by using a latent adhesive greatly simplifies assembly. This also avoids the need for precise machining, or the need for shims and locking rings such as used in the prior art.

While the invention has been shown in only one of its forms, it should be apparent to those skilled in the art that it is not so limited but is susceptible to various changes and modifications without departing from the spirit of the invention.

I claim:

1. A centrifugal pump, comprising in combination:

a tubular housing;

a shaft rotatably carried inside the housing;

a plurality of spaced-apart diffusers surrounding the shaft and stationarily carried in the housing; and a plurality of impellers, each having a bore receiving the shaft and carried between two of the diffusers, the impellers being locked to the shaft by a locking member inserted in the bore of each impeller, the locking member being of a solid elastomeric material that expands when heated and remains expanded and harder after cooling.

2. The pump according to claim 1 wherein the bore of each impeller has a recess that extends part of the length of each of the impellers, and wherein the locking member is located within the recess.

* * * * *